US007218298B2

(12) United States Patent
Yamazaki et al.

(10) Patent No.: US 7,218,298 B2
(45) Date of Patent: May 15, 2007

(54) LIGHT EMITTING DEVICE

(75) Inventors: Yu Yamazaki, Tokyo (JP); Aya Anzai, Kanagawa (JP); Mitsuaki Osame, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 201 days.

(21) Appl. No.: 10/405,335

(22) Filed: Apr. 2, 2003

(65) Prior Publication Data

US 2003/0189410 A1 Oct. 9, 2003

(30) Foreign Application Priority Data

Apr. 3, 2002 (JP) ..... 2002-101950

(51) Int. Cl.
*G09G 3/32* (2006.01)

(52) U.S. Cl. ..... 345/83; 345/76

(58) Field of Classification Search ..... 345/36, 345/39, 45, 72, 76, 83
See application file for complete search history.

(56) References Cited

U.S. PATENT DOCUMENTS

| | | | | |
|---|---|---|---|---|
| 4,450,715 | A * | 5/1984 | Sumal | 73/118.1 |
| 4,888,523 | A | 12/1989 | Shoji et al. | 315/169.3 |
| 5,399,502 | A | 3/1995 | Friend et al. | 437/1 |
| 5,652,600 | A | 7/1997 | Khormaei et al. | 345/76 |
| 5,940,053 | A | 8/1999 | Ikeda | 345/77 |
| 5,990,629 | A * | 11/1999 | Yamada et al. | 315/169.3 |
| 6,078,304 | A | 6/2000 | Miyazawa | 345/88 |
| 6,246,180 | B1 | 6/2001 | Nishigaki | 315/169.3 |
| 6,339,411 | B2 | 1/2002 | Miyazaki et al. | 345/1.1 |
| 6,424,326 | B2 * | 7/2002 | Yamazaki et al. | 345/77 |
| 6,498,356 | B1 * | 12/2002 | Sekiya et al. | 257/113 |
| 6,538,242 | B1 * | 3/2003 | Kuno et al. | 250/208.1 |
| 6,839,045 | B2 | 1/2005 | Ozawa et al. | 345/92 |
| 2001/0028060 | A1 | 10/2001 | Yamazaki et al. | 257/72 |
| 2003/0089410 | A1 | 5/2003 | Young | 138/30 |
| 2003/0174106 | A1 | 9/2003 | Tanada et al. | 345/83 |
| 2004/0041781 | A1 | 3/2004 | Sato et al. | 345/102 |

FOREIGN PATENT DOCUMENTS

| | | |
|---|---|---|
| EP | 1 061 497 | 12/2000 |

(Continued)

OTHER PUBLICATIONS

Complete English translation of Japanese Patent Application No. JP 10-39791.

(Continued)

*Primary Examiner*—Richard Hjerpe
*Assistant Examiner*—Jean Lesperance
(74) *Attorney, Agent, or Firm*—Cook, Alex, McFarron, Manzo, Cummings & Mehler, Ltd.

(57) ABSTRACT

This invention provides a light emitting device in which each pixel has three sub-pixels for emitting different colors, comprising a signal correction circuit for correcting gradation information of each signal depending on the light emitting index of each sub-pixels, characterized in that; the signal correction circuit has a means to calculate a signal having gradation information according to the following formulae; multiplying the gradation information of the signal input into the three sub-pixels by $(1/\alpha):(1/\beta):(1/\gamma)$, when the ratio of the light emitting indexes of the three sub-pixels is $\alpha:\beta:\gamma$.

27 Claims, 7 Drawing Sheets

FOREIGN PATENT DOCUMENTS

| | | |
|---|---|---|
| JP | 10-39791 | 2/1998 |
| JP | 2001-060076 | 3/2001 |
| JP | 2001-102626 | 4/2001 |
| JP | 2001-257163 | 9/2001 |
| JP | 3259388 | 12/2001 |
| JP | 3259488 | 12/2001 |

OTHER PUBLICATIONS

Yumoto, A. et al, "Pixel-Driving Methods for Large-Sized Poly-Si AM-OLED Displays," Asia Display/IDW '01, pp. 1395-1398, (2001).

* cited by examiner

R:G:B=$\alpha$:$\beta$:$\gamma$

R:G:B=$\alpha$:$\beta$:$\gamma$=(1.0):(1.14):(1.08)

LIGHT EMITTING DEVICE

BACKGROUND OF THE INVENTION

1. Field of the Invention

The present invention relates to a field of light emitting device using light emitting element, more particularly, a light emitting device for multi-color display.

2. Description of the Related Art

Recently, research and development on the image display devices is vigorously conducted. As a display, liquid crystal displays using liquid crystal elements for displaying images are widely used today as displays on mobile telephones and personal computers, with making best use of their advantages such as high-quality image, and thin and light body.

At the same time, the development of light emitting devices using light emitting elements is also underway. A light emitting device of this type has many advantages such as quick response, capacity for displaying moving pictures, and wide field of view, in addition to the above advantages of existing liquid crystal displays. Therefore, the light emitting device using light emitting elements attracts attention as a next generation flat panel display for small mobile devices which are capable of providing moving picture contents.

A light emitting element is made from various materials including organic materials, inorganic materials, thin-film materials, bulk materials and dispersing materials. Among them, an organic light emitting diode (OLED), mainly consisting of organic materials, is one of representative light emitting elements. The light emitting element has a structure consisting of an anode and a cathode, and a light emitting layer interposed therebetween. The light emitting layer comprises one or more materials selected from the above materials.

In these days, light emitting devices in which each pixel is divided into three sub-pixels are being developed actively. Each of the three sub-pixels corresponds to the light's three primary colors R (red), G (green) and B (blue), respectively. The light emitting device provides multi-color display by displaying each sub-pixel corresponding to each color with gradation. Examples of methods for multi-color display include a method in which three light emitting elements are made from three light emitting materials corresponding to R, G and B, respectively, a method in which light emitting elements emitting white color are combined with color filters for R, G and B, respectively, and a method in which light emitting elements emitting any color are combined with color conversion materials (such as fluorescent materials).

In the light emitting device, multi-color can be displayed by using so-called additive color mixing method in which a variety of colors are generated by combining R, G and/or B. This technique utilizes a fact that human eyes have sensors sensitive to the wavelength of a light, and recognize colors by dividing the wavelength of the light incident on the eyes.

Next, the above mentioned additive color mixing will be discussed with reference to the FIGS. 8A and 8B. The FIG. 8A shows a graph in which brightness is plotted on the vertical axis and the light wavelength is plotted on the horizontal axis. As can be seen in FIG. 8A, a visible light can be divided into three regions according to the length of its wavelength. The long wavelength represents red, medium wavelength represents green and short wavelength represents blue. Also as can be seen in FIG. 8B, yellow, magenta and cyan are generated by combining the three light's primary colors. When nearly equal amount of red light, green light and blue light enter the eye, the eye recognizes the light as white color. Thus, by adjusting brightness (balance) of the three primary colors (red, green, blue), a variety of colors can be reproduced.

As for driving methods of a light emitting device, the analogue gradation method and the digital gradation method are currently in use. In the analogue gradation method, the amount of the current flowing through the light emitting element is controlled to generate gradation. In the digital gradation method, the light emitting element is driven by switching between two states, ON (almost 100% luminance) state and OFF (almost 0% luminance) state. Namely, the digital gradation method as is can display only two gradations. Therefore, methods which combines the digital gradation method with other method to display colors in multi-gradations have been proposed. Examples of such combined method for reproducing multi-gradation colors include an area gradation method and a time gradation method.

The driving methods of the light emitting devices for displaying multi-gradation image include a voltage input method and a current input method. In the voltage input method, a video signal (voltage) input into a pixel is input into the gate electrode of a driving element, which, in turn is used to control the luminance of the light emitted from the light emitting element. In the current input method, a preset signal current flows from one electrode to another electrode of the light emitting element, in order to control the luminance of the light emitted from the emitting element. Either the voltage input method or the current input method is applicable for the analog gradation method or the digital gradation method.

Different light emitting material for emitting different color necessary for the multi-color display has different current density for achieving certain luminance. For example, in the various light emitting materials for emitting one of light's three primary colors, materials for red typically have lower luminance than those for blue and green.

Furthermore, a color conversion layer of a color filter or a fluorescent filter has different transmittance for different color. Therefore, even when the light emitting elements emit light with uniform luminance, the light passing through the color conversion layer will change the luminance.

When above light emitting materials or color conversion layers such as color filters are used in the sub-pixels without modification, the lights emitted from each sub-pixel may have different luminance from each other. Also, as discussed with reference to the FIGS. 8A and 8B, white color is represented by emitting lights three primary color RGB at the same time. Therefore, if there is any difference in luminance among three colors, white color displayed on the screen may be biased to red or blue, thus, is not accurately reproduced. The luminance on the display may be uneven, or white balance may be impaired, and desirable color and image with accurate gradation cannot be reproduced.

SUMMARY OF THE INVENTION

The present invention employs the digital gradation method to express multi-gradation images. In the digital gradation method, when the light emitting element is turned ON (nearly 100% luminance), sub-fields are supplied with digital video signals having same voltage. Making use of this fact, we defines a light emitting index as a luminance of the light emitted from each sub-pixel when same signal voltage is applied to the sub-pixels.

More specifically, the light emitting index is defined as a luminance based on the value of current flowing from one electrode to another electrode of the light emitting element in each sub-pixel, when same signal voltage is applied to the sub-pixels.

The present invention provides a light emitting device which can reduce difference in the luminance among the lights emitted from sub-pixels, by correcting the signals input into sub-pixels according to the above light emitting index. More particularly, the invention provides a light emitting device which corrects gradation information of the signals input into sub-pixels, so as to make the gradation number of the sub-pixel for a color having the lowest light emitting index the maximum. By correcting the gradation information of the signals input into sub-pixels, the invention provides a light emitting device which can reproduce even luminance and white balance on the display. The light emitting device according to the invention can reproduce desirable high-quality image with accurate color and gradation.

In this invention, the term "correction of signal" refers to the correction of the signal itself rather than the correction of the voltage of a digital video signal. More particularly, the correction is made on the gradation information (gradation) of a signal. The gradation information of a signal is the information representing a nth gradation (n is a natural number) in the range from the first gradation to the maximum gradation. When a signal is input into a pixel, the pixel expresses the gradation in response to the gradation information of the input signal.

Also, a sub-pixel is either a sub-pixel comprising a material for emitting one of the color in the light's three primary colors RGB, a sub-pixel comprising a material for emitting one color by combining a color selected from the light's three primary colors and complementary color of the selected color, a sub-pixel comprising two or more materials emitting any color, a sub-pixel comprising a light emitting material which emits either white color or mixed color, and a color filter, and a sub-pixel comprising a color conversion material such as a luminance material. Each sub-pixel preferably emits one light selected from RGB, however, this invention is not limited to this particular construction. Sub-pixels emitting colors other than RGB such as orange or blue-green are also acceptable. The above sub-pixels may be sometimes called only "pixel", however in this specification, a sub-pixel corresponding to one color is referred to as a "sub-pixel", and a pixel having a plurality of sub-pixels is referred to as a "pixel".

The purpose of the present invention is to provide a light emitting device in which one pixel has a plurality of sub-pixels provided with light emitting elements, and a signal correction circuit for correcting gradation information of a signal voltage, characterized in that; the signal correction circuit comprises a means for calculating a product of the signal voltage and the inverse number of the luminance of the light emitting elements when same signal voltage is applied to the plurality of sub-pixels.

Another purpose of the invention is to provide a light emitting device in which one pixel has a plurality of sub-pixels provided with light emitting elements for emitting different color from each other, and a signal correction circuit for correcting gradation information of a signal voltage, characterized in that; the signal correction circuit has a means for calculating a product of the inverse number of each light emitting index of the sub-pixels, and the signal voltage, each of the plurality of sub-pixel has a driving means for supplying current to the light emitting element, and a current supply means for supplying current to the driving means, and; the current supply means of the plurality of sub-pixels are connected to one power supply.

As described, the invention calculates the product of the inverse number of the light emitting index defined for each sub-pixel, and the signal input into the sub-pixel. The resulting product forms the corrected signal which, in turn, is used for multi-gradation display. In this manner, lights emitted from sub-pixels are balanced, and even when the sub-pixels are connected to one power source, a gradation can be reproduced with higher accuracy.

The invention provides a light emitting device in which one pixel comprises three sub-pixels emitting different color from each other, characterized in that the device comprises a signal correction circuit for correcting gradation information of a signal based on the light emitting index of the sub-pixel. Each of the three sub-pixels has a light emitting means with a first electrode and a second electrode, a driving means for supplying predetermined current to the light emitting means, and a current supply means for supplying current to the driving means. The signal correction circuit is characterized in that it comprises a means for calculating a signal for gradation information. The signal for gradation information is calculated by multiplying the gradation information of the signal input into a sub-pixel by $(1/\alpha):(1/\beta):(1/\gamma)$, when the ratio of the light emitting indexes of the three sub-pixel is $\alpha:\beta:\gamma$.

The light emitting device according to the invention is characterized in that above three sub-pixels have common current supply means. That is, the current supply means for above three sub-pixels are connected to one power supply. This is because the voltage from one power supply can be applied to the three sub-pixels, since the three sub-pixels are supplied with video signals having same voltage. This configuration allows for higher aperture ratio for the sub-pixel.

The light emitting device according to the invention is characterized in that it has a pixel portion in a matrix arrangement in which a plurality of pixels are arranged in row-direction which is scanned in horizontal direction and a plurality of pixels are arranged in column-direction which is scanned in a direction perpendicular to the row, and that the current supply means for the plurality of pixels are connected to one power supply. This is because the voltage from the one power source can be applied to the sub-pixels, since the sub-pixels are supplied with video signals having same voltage. That is, it is not necessary to provide separate power supply for each sub-pixel. Instead, all the pixels are supplied with voltage from one power supply. Therefore, the light emitting device is sufficed with less number of power supplies, leading to reduction in size and thickness of the device.

The invention provides a light emitting device in which one pixel comprises three sub-pixels for emitting different color from each other, characterized in that the device comprises a signal correction circuit for correcting gradation information of a signal depending on the light emitting index of each sub-pixels, and a time division signal generation circuit to set a plurality of sub-frame periods in a unit frame period. The signal correction circuit is characterized in that it comprises a means for calculating a signal for gradation information. The signal for gradation information is calculated by multiplying the gradation information of the signal input into a sub-pixel by $(1/\alpha):(1/\beta):(1/\gamma)$, when the ratio of the light emitting indexes of the three sub-pixel is $\alpha:\beta:\gamma$. The time division signal generation circuit is characterized in that it comprises a means for setting a light emitting status and a non-light emitting status (a lightening status and a non-lightening status) of the sub-pixel, in each sub-frame period in the plurality of sub-frame periods, depending on the signal calculated by the signal correction circuit.

The light emitting status (lightening) of the sub-pixel is a status in which the current is supplied to the light emitting means and light is emitted from the sub-pixel. The non-light emitting status (non-lightening) of the sub-pixel is a status in which there is no difference in voltage between the two electrodes of the light emitting means, and no current is supplied.

DESCRIPTION OF THE PREFERRED EMBODIMENT

[Embodiment 1]

In this embodiment, the construction of a light emitting device according to the invention is described with reference to the FIGS. 1, 2A and 2B.

First, the construction of the light emitting device will be described with reference to the FIG. 1. The light emitting device has a pixel portion 102 in which (m×n) pixels 101 are arranged in a row and column matrix on the substrate 107. The pixel 101 has three sub-pixels, each of which emits one color of RGB, respectively. The three sub-pixels may be sub-pixels emitting light from the light emitting element without change, or sub-pixels emitting light through a color conversion layer such as a color filter or a luminescent filter. Sub-pixels with any construction is applicable.

Figure 1:
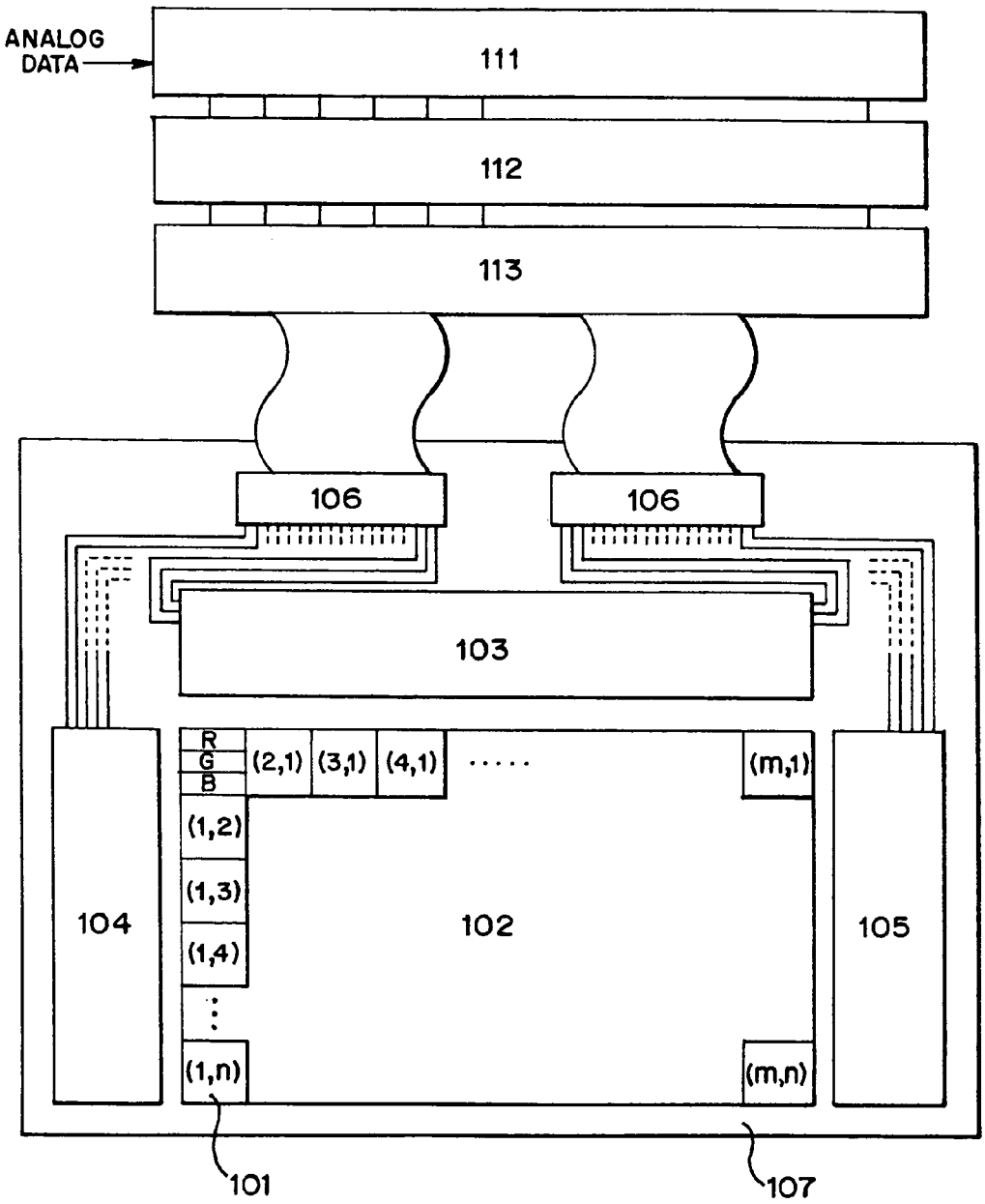
FIG. 1 is the drawing which shows a light emitting device according to the invention.
Figure 2A:
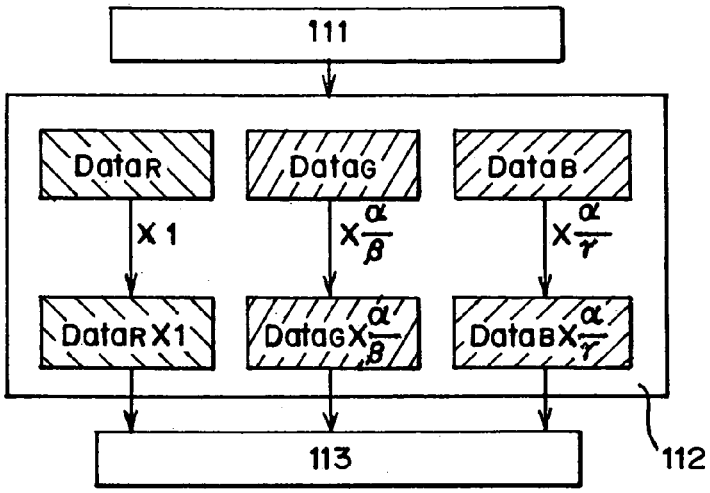
FIGS. 2A and 2B are the drawings which show light emitting devices according to the invention.
Figure 2B:
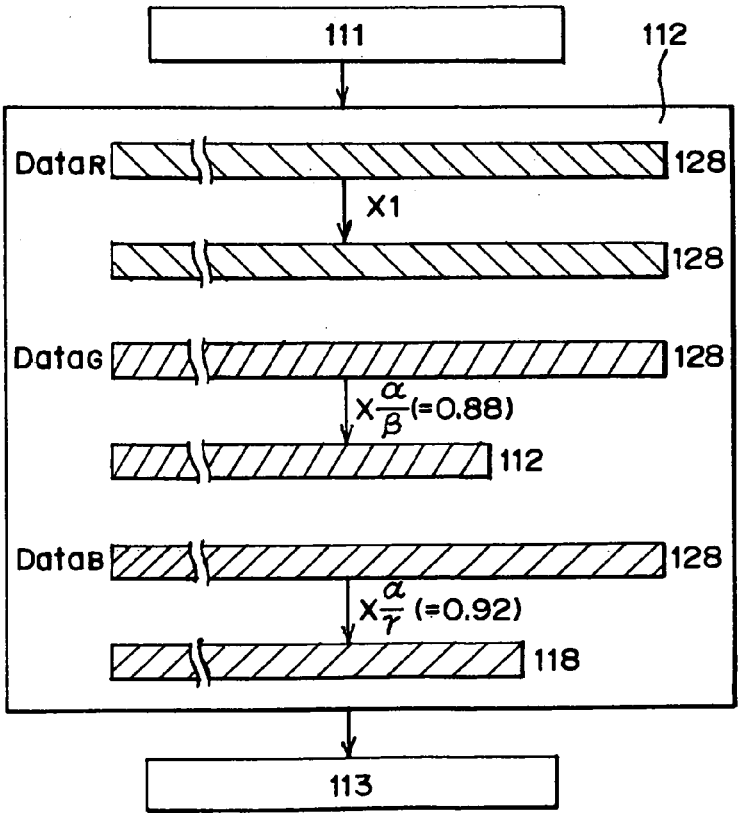

The FIG. 1 shows a horizontal stripe array in which sub-pixels with same color are aligned in horizontal direction, however, the invention is not limited to this particular construction. For example, a vertical stripe array in which sub-pixels with same color are aligned in vertical direction, a delta array in which sub-pixels are displaced by half sub-pixel for each row, a mosaic array in which sub-pixels are displaced by one sub-pixel for each row, or a square array in which four sub-pixels form one pixel is also applicable. Also in the FIG. 1, the pixel 101 has three sub-pixels, each of which emits light with one of the RGB colors, however, the invention is not limited to this particular construction. The number of sub-pixels included in the pixel 101 and the color of the light emitted from each sub-pixel can be defined as desired.

The light emitting element in each sub-pixel has a construction comprising an anode, a cathode, and a light emitting layer interposed therebetween. The light emitting layer comprises one or more material selected from organic materials, inorganic materials and bulk materials. The desirable light emitting layer has same film thickness for every sub-pixel, however, the invention is not limited to this particular construction. By modifying the film thickness of the sub-pixels, the difference in the luminance among colors can further be reduced.

The light emitting device has a signal line driving circuit 103, a first scan line driving circuit 104 and a second scan line driving circuit 105, on the periphery of the pixel portion 102. The signal line driving circuit 103, the first and second scan line driving circuits 104 and 105 are supplied with signals from an external device via a FPC 106. The signal line driving circuit 103, the first and second scan line driving circuits 104 and 105 may be disposed outside of the substrate 107 on which the pixel portion 102 is formed. Also, FIG. 1 shows a construction having one signal driving circuit and two scan line driving circuits, however, the number of these circuits is not limited. Any number of these driving circuits can be disposed depending on the construction of the pixel 101.

The light emitting device includes a light emitting panel in which a pixel portion having light emitting elements, and a driving circuit are sealed between a substrate and a cover material, a light emitting module which implements ICs on the light emitting panel, and a light emitting display which is used as a display device. That is, light emitting panels, light emitting modules and light emitting displays can be implemented using a light emitting device according to the invention.

The signal driving circuit 103 is connected to an A/D conversion circuit 111, a signal correction circuit 112 and a time-division signal generation circuit 113 via the FPC 106.

The A/D conversion circuit 111 converts analog video signals (analog data) input from an external device, into digital video signals (digital data). The signal correction circuit 112 corrects the signal input from the A/D conversion circuit 111, to a signal corresponding to the light emitting index of each sub-pixel for each color. The time-division signal generation circuit 113 converts the signal input from the signal correction circuit 112, into a signal according to the time gradation method.

Next, the operation of the A/D conversion circuit 111, the signal correction circuit 112 and the time-division signal generation circuit 113 will be described in detail with reference to the FIG. 2.

In this invention, the ratio of the light emitting index of the each sub-pixel for RGB is R:G:B=$\alpha$:$\beta$:$\gamma$. These light emitting indexes can be stored on the storage medium provided in the signal correction circuit 112 based on the measurement conducted in advance, or indexes can be adjusted based on measurements conducted at regular interval. Also, the light emitting index can be adjusted to any value externally at any time. For example, when an electronics device is operated via a telecommunication link, the value of the light emitting index can be adjusted by downloading data. This allows for easy adjustment of white balance on the display of the electronics device in use.

In this discussion, the R signal output from the A/D conversion circuit 111 is referred to as $Data_R$, the G signal is referred to as $Data_G$, and the B signal is referred to as $Data_B$. In this invention, the gradation information represented by each signal for RGB is multiplied by R:G:B=$(1/\alpha):(1/\beta):(1/\gamma)$ in order to reduce difference in the luminance of sub-pixels. It should be noted that the adjustment should be made such that the gradation number of a signal for a color having lowest light emitting index will be the maximum. That is, the adjustment can be made by multiplying the gradation information of the signal for the color having lowest light emitting index by 1, so as to make the gradation number of the signal with lowest light emitting index the maximum. For illustrating purpose, the light emitting index of the R is the lowest in this embodiment, and the gradation information represented by each signal for RGB is multiplied by R:G:B=1:(α/β):(α/γ).

Thus, the signal correction circuit 112 corrects signals input from the A/D conversion circuit 111, to a signal corresponding to the light emitting index of the sub-pixel for RGB. Then, each signal for RGB corrected in the signal correction circuit 112 is input into the time division signal generation circuit 113.

Next, the operation of the signal correction circuit 112 will be described in detail with reference to the FIG. 2B. If the luminance of light emitted from light emitting means are 100 candela, 114 candela and 108 candela, respectively, when 3.0V signal voltage is equally applied to the driving means of the sub-pixels for RGB, the ratio of the light emitting indexes of the sub-pixels for RGB will be R:G:B=(1.0):(1.14):(1.08), which means that the light emitting index for R is the lowest.

Suppose that same signals for RGB are equally input from the A/D conversion circuit 111 to the signal correction circuit 112, and all signals for RGB represent the 128th gradation information.

In this case, as the light emitting index of R has the lowest value, the $Data_R$ is corrected by multiplying 1. The $Data_R$ is converted into a signal representing the 128th gradation information. $Data_G$ is corrected by multiplying (α/β)=0.88 and converted into a signal representing the 112th gradation information. $Data_B$ is corrected by multiplying (α/γ)=0.92 and converted into a signal representing the 118th gradation information. Thus, the signal correction circuit 112 corrects gradation information of a signal, according to the light emitting indexes of the RGB sub-pixels. The signals representing corrected gradation information ($Data_R$=128, $Data_G$=112, $Data_B$=118) are input into the time-division signal generation circuit 113.

The signal converted in the signal correction circuit 112 may be subject to the y correction as necessary. Also, in this embodiment, the analog signal is converted into a digital signal in the A/D conversion circuit 111, then the resultant signal is corrected in the signal correction circuit 112 based on the light emitting index of each color, however, the invention is not limited to this particular arrangement. Instead, the A/D conversion circuit 111 can be omitted and the analog signal can be directly input into the signal correction circuit 112 without change.

The present invention can reduce the difference in the luminance of sub-pixels for each color, by correcting the signal input into each sub-pixel, based on the light emitting index. Particularly, the gradation information of the signal input into each sub-pixel is corrected so as to make the gradation number of sub-pixel having the lowest light emitting index the maximum. As a result, the difference in the luminance is reduced and the white balance is improved on the display, and desirable high-quality image with accurate color and gradation can be reproduced.

The above sub-pixels include the pixels which use the light emitted from the light emitting element without change, and the pixels which use a color conversion layer such as a color filter or a fluorescent filter. The light emitting index of the former type pixel primarily depends on the current density of the light emitting material for each color. Also, the light emitting index of the latter type pixel primarily depends on the transmittance of each color passing through the color conversion layer.

In this embodiment, the signals input into each sub-pixel is corrected so that all sub-pixels have same luminance, in order to achieve optimum white balance. However, it should be noted that the invention is not limited to this particular implementation. Depending on the color emitted from a sub-pixel, little difference in the luminance may improve white balance. In other words, the adjustment of the signal can be made depending on the color of the light emitted from each sub-pixel.

In the light emitting device with the above structure according to the invention, power supply lines for sub-pixels can be connected to one power supply, that is, sub-pixels do not need to have separate power supply line. This construction reduces the number of manufacturing steps and improves the yield. Furthermore, if an aperture equal to that in an existing construction in which every sub-pixel has a respective power supply line, the pixel size can be reduced by an amount equivalent to the area occupied by the power supply line, leading to a higher aperture ratio.

[Embodiment 2]

In this embodiment, the construction and operation of the pixel 101 on the i-th column and the j-th row of the pixel portion 102 is described with reference to the FIGS. 3 and 4.

The pixel 101 has three sub-pixels 141, 142 and 143. The area surrounded by a signal line $S_i$, a first scan line $Gr_j$, a second scan line $Rr_j$ and a power supply line $V_k$ corresponds to the sub-pixel 141 for R, the area surrounded by the signal line $S_i$, a first scan line $Gg_j$, a second scan line $Rg_j$, and the power supply line $V_k$ corresponds to the sub-pixel 142 for G. The area surrounded by the signal line $S_i$, a first scan line $Gb_j$, a second scan line $Rb_j$ and the power supply line $V_k$ corresponds to the sub-pixel 141 for B.

Each sub-pixel 141, 142 and 143 has a switching transistor 131, a driving transistor 132, a clearing transistor 133 and a light emitting element 134, respectively.

In the sub-pixel 141, the switching transistor 131 and the clearing transistor 133 are connected in parallel and disposed between the Signal line $S_i$ and the power supply line $V_k$. The gate electrode of the switching transistor 131 is connected to the first scan line $Gr_j$, while the gate electrode of the clearing transistor 133 is connected to the second scan line $Rr_j$. The first electrode of the driving transistor 132 is connected to the power supply line $V_k$, while the second electrode of it is connected to one of the electrodes of the light emitting element 134. The other electrode of the light emitting element 134 is connected to the opposite power supply 135. The explanation on the structure of the sub-pixels 142 and 143 is omitted because it is similar to that of the sub-pixel 141.

In this specification, one electrode of the light emitting element 134 connected to the second electrode of the driving transistor 132 is referred to as a pixel electrode, and the another electrode connected to the opposite power supply 135 is referred to as an opposite electrode.

Figure 3:
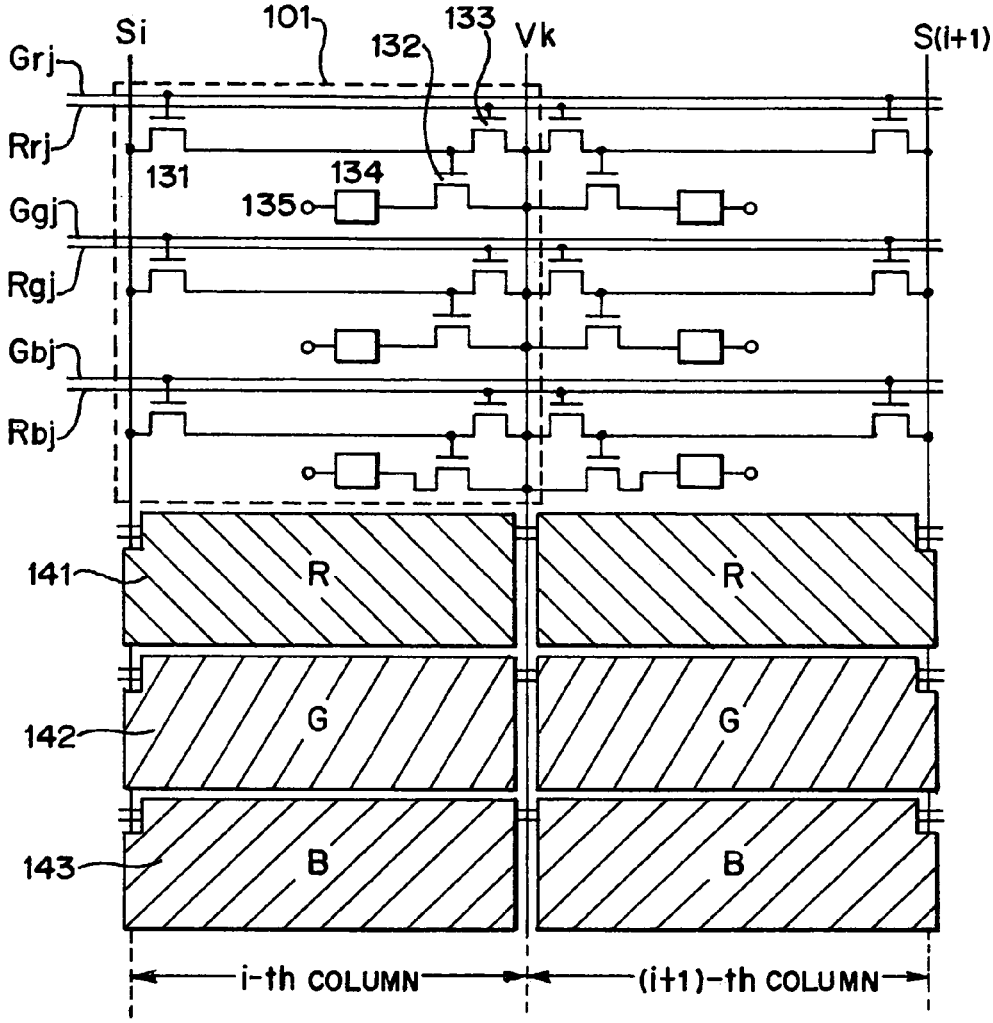
FIG. 3 is the circuit diagram of a pixel provided in a light emitting device according to the invention.

In the FIG. 3, the pixel 101 on the i-th column and the pixel 101 on the i+1 column have a common power supply line $V_k$. This is because each-pixel 101 are supplied with same signal voltage so that each-pixel 101 can share one power supply. It is not necessary to provide separate power supply line for each column, and adjacent columns can have a common power supply line. As a result, the higher aperture ratio can be obtained for the pixel 101.

In the FIG. 3, the sub-pixels 141, 142 and 143 of the RGB have a common power supply line $V_k$. This is because sub-pixels 141, 142 and 143 are supplied with same signal voltage so that sub-pixels 141, 142 and 143 can share one power supply. It is not necessary to provide separate power supply line for each sub-pixel, and adjacent sub-pixels can have a common power supply line. As a result, the number of the power supply to be provided in the light emitting device can be reduced, leading to reduction in size and thickness of the light emitting device.

It should be noted that the FIG. 3 shows an arrangement in which the adjacent two columns have a common power supply line, but the invention is not limited to this particular construction. Any number of columns can share one power supply line. When sub-pixels are arranged in vertical stripes, a power supply line can be shared by adjacent rows.

Also, each column may have respective power supply line, rather than one common power supply line. In this case, a power supply connected to the power supply line can be provided for each color so as to adjust the voltage of the power supply for each color. This structure further reduces the difference in the luminance among sub-pixels.

Although not shown in the FIG. 3, a capacitance element can be provided as a means to retain gate-source voltage of the driving transistor 132. However, when the gate capacitance or the channel capacitance of the driving transistor 132, or the parasitic capacitance of the line is used as a means to retain gate-source voltage of the driving transistor 132, additional capacitance element is not necessary.

The switching transistor 131 has a function to control signals input into sub-pixels 141, 142 and 143. The switching transistor 131 only need to function as a switch, so that any conductivity type is applicable. Either n-channel type transistor or p-channel type transistor is applicable for the switching transistor 131.

The driving transistor 132 has a function to control the light emitting status of the light emitting element 134. Any conductivity type transistor is applicable for the driving transistor 132. When a p-channel type transistor forms the driving transistor 132, the pixel electrode will be an anode and the opposite electrode will be a cathode. When a n-channel type transistor forms the driving transistor 132, the pixel electrode will be an anode and the opposite electrode will be a cathode.

The clearing transistor 133 has a function to stop the light emission of sub-pixels 141, 142 and 143. The clearing transistor 133 only needs to serve as a switch, so that any conductivity type transistor is applicable. Either n-channel type transistor or p-channel type transistor is applicable for the clearing transistor 133.

The transistor for sub-pixels 141, 142 and 143 may have either single gate structure which has one gate electrode, or multi-gate structure such as a double gate-structure which has two gate electrodes and a triple gate-structure which has three gate electrodes. The gate structure may either be a top-gate structure in which the gate electrode is located on the top of the semiconductor, or a bottom-gate structure in which the gate electrode is located on the bottom of the semiconductor.

Next, the operation of the light emitting device of the invention is described with reference to the FIG. 4. In the timing chart of the FIG. 4, time is plotted on the horizontal axis and the scan line is plotted on the vertical axis.

As the light emitting device of the invention employs the time gradation method, one frame period is divided into a plurality of sub-frame periods SF. Each sub-frame period SF has an address period Ta and a sustain period Ts, or an address period Ta, a sustain period Ts and a clearing period Te.

The clearing period Te is provided to the sub-frame period SF having a sustain period Ts shorter than an address period Ta. This prevents the subsequent address period Ta from starting immediately after the sustain period Ts. When the address period Ta starts immediately after the sustain period Ts, two scan lines are selected at one time, which leads to inaccurate signal input from the signal line to the pixel.

In the time gradation method, each sub-frame period SF has different light emitting duration, and the gradation is expressed by combining light-emitting status and non-light emitting status of sub-frame periods SF. In the example shown in the FIG. 4, the gradation number is 5 bits and one frame period is divided into five sub-frame periods SF1 to SF5. The ratio of duration of the sustain periods Ts1 to Ts5 of each sub-frame period is Ts1:Ts2:Ts3:Ts4:Ts5=16:8:4:2:1, that is, the values are powers of two to express multi-gradation. When n-bit gradation is to be expressed, the ratio of the sustain periods Ts1 to Tsn will be $2^{(n-1)}:2^{(n-2)}:{}_{C}2^{1}2^{0}$.

The address period Ta is the period in which a digital video signal is written in each pixel. All sub-frame periods SF has the address period with same duration. The sustain period Ts is the period in which the light emitting element emits light, or does not emit light, based on the video signal written in the pixel.

Next, the operations during above address period Ta, the sustain period Ts and the clearing period Te are described with reference to the sub-pixel 141.

In the address period Ta, the first scan line $Gr_j$ goes H level in response to the supply of a pulse, to turn on the switching transistor 131. Then a digital video signal output to the signal line $S_i$ is input into the gate electrode of the driving transistor 132.

Next in the sustain period Ts, the driving transistor 132 is turned on to allow current to flow through the light emitting element 134 due to the voltage difference between the power supply line $V_k$ and the opposite power supply 135. The light emitting elements 134 emits light. When the driving transistor 132 is turned off, the current does not flow through the light emitting element 134, thus, the element emits no light.

Next, in the clearing period Te, the second scan line $Rr_j$ goes H level in response to the supply of a pulse, to turn on the clearing transistor 133. When the clearing transistor 133 is turned on, the gate-source voltage of the driving transistor 132 goes zero to turn off the driving transistor 132. No current flows through the light emitting element 134 and no light is emitted from the element. It should be noted that the clearing period Te is provided only for the sub-frame period SF5. This prevents the subsequent address period from starting immediately after the sustain period Ts5, because the sub-frame period SF5 has a sustain period Ts5 shorter than the address period Ta5.

Figure 4:
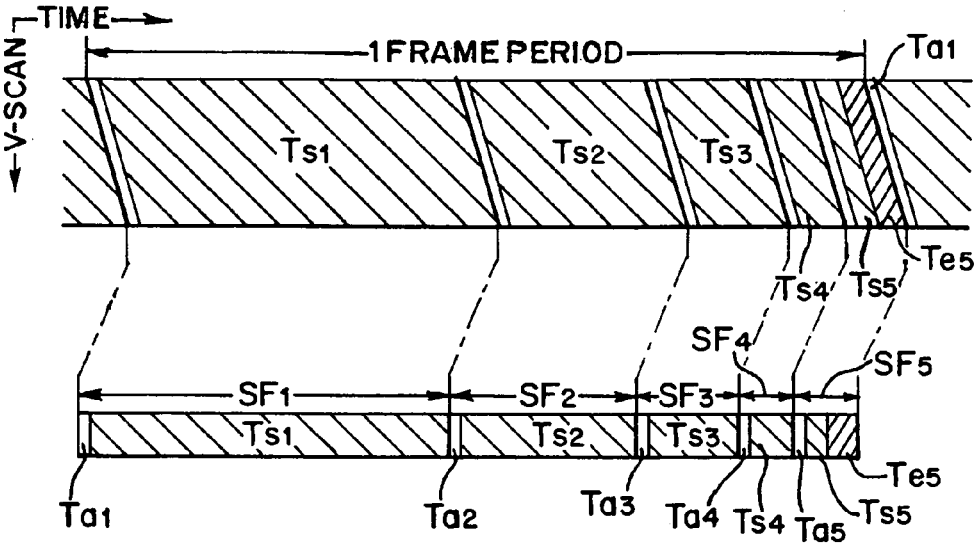
FIG. 4 is a drawing which illustrates a driving method of a light emitting device according to the invention.

It should be noted that, although in the timing chart of the FIG. 4, the sub-frame periods SF1 to SF5 appear sequentially in this order, the invention is not limited to this particular construction. The sub-frame period can appear in a random manner. Also, in order to prevent any pseud-contour from occurring, it is possible to divide any sub-frame period to cause it appear separately.

This embodiment can be implemented in conjunction with the embodiment 1.

[Embodiment 3]

In this embodiment, the constructions and the operations of the signal line driving circuit 103, the first and second scan line driving circuits 104 and 105, respectively, will be described with reference to the FIG. 5.

Figure 5A:
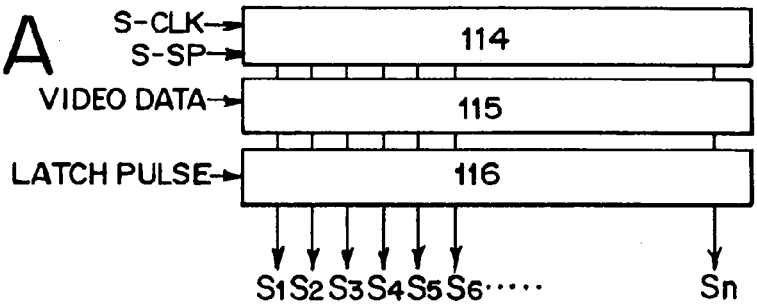
FIGS. 5A and 5B are the drawings which show a signal driving circuit and scan line driving circuits of a light emitting device according to the invention.

First, the signal line driving circuit 103 is described with reference to the FIG. 5A. The signal line driving circuit 103 has a shift register 114, a first latch circuit 115 and a second latch circuit 116.

The operation of the signal driving circuit 103 is described briefly. The shift register 114 comprises a plurality of flip-flop circuit (FF), and is supplied with a clock signal (S-CLK), a start pulse (S-SP), and a clock inversion signal (S-CLKb). Sampling pulses are output one by one according to the timing of these signals.

The sampling pulse output from the shift register 114 is input into the first latch circuit 115. The first latch circuit 115 is supplied with digital video signals, which, in turn, are retained in each column according to the timing of the input of the sampling pulse.

In the first latch circuit 115, when the columns from the first to the last are filled with the retained video signals, a latch pulse is input into the second latch circuit 116 during the horizontal return line period. The video signals retained in the first latch circuit 115 are transferred to the second latch circuit 116, at the same time. Then, the one line of the video signals retained in the second latch circuit 116 is input into the signal lines $S_1$ to $S_n$, at the same time.

While the video signals retained in the second latch circuit 116 are being input into the signal lines $S_1$ to $S_n$, sampling pulses are again output from the shift register 114. The above operation is repeated.

Figure 5B:
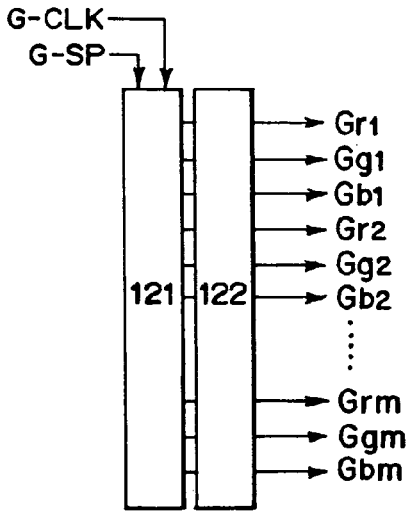

Next, the first and second scan line driving circuits 104 and 105 are described with reference to the FIG. 5B. The first and second scan line driving circuits 104 and 105 have a shift register 121 and a buffer 122, respectively. Briefly, the shift register 121 outputs sampling pulses one by one according to the clock signal (G-CLK), a start pulse (G-SP) and a clock inversion signal (G-CLKb). Next, the sampling pulses amplified in the buffer 122 are input into the scan line, and the scan line is turned to be selected status one by one in response to the input of the sampling pulse. The pixel controlled by the selected scan line is supplied with digital video signals from signal lines $S_1$ to $S_n$ in sequence.

A level shifter circuit may be provided between the shift register 121 and the buffer 122. By providing a level shifter circuit, the voltage amplitudes of the logic circuit part and the buffer can be altered.

This embodiment can be implemented in conjunction with embodiment 1 and/or 2.

[Embodiment 4]

In this embodiment, an exemplary layout of the pixel 101 having circuit structure shown in the FIG. 3 will be described with reference to the FIG. 6.

Figure 6:
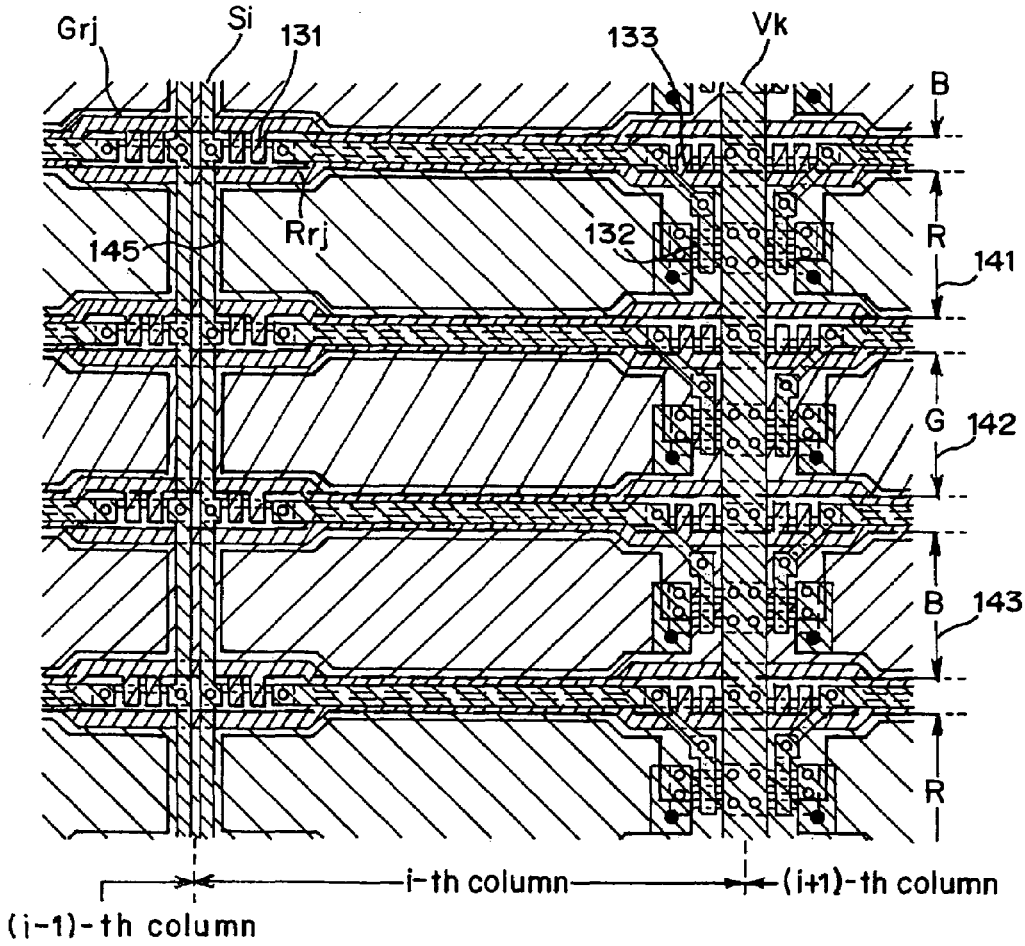
FIG. 6 shows a layout of a pixel provided in a light emitting device according to the invention.

In the FIG. 6, $S_i$ is a source signal line, $Gr_i$ is a first scan line, $Rr_j$ is a second scan line, and $V_k$ is a current supply line. Reference numeral 131 represents a switching transistor, 133 represents a clearing transistor, 132 represents a driving transistor and 145 represents a pixel electrode. The light emitting layer and the opposite electrode of the light emitting element are not shown.

Although the switching transistor 131 and the clearing transistor 133 are double-gate type transistors in this figure, the invention is not limited to this particular construction. Any single-gate type transistor or multi-gate type transistor with any number of gates is also applicable.

In the FIG. 6, the pixel on the i-th column and the pixel on the i+1 column have a common power supply line $V_k$. This is because these each-pixel 101 are supplied with the same signal voltage so that the each-pixel can be supplied from one power supply. It is not necessary to provide separate power supply line for each column, and adjacent columns can have a common power supply line. As a result, a higher aperture ratio can be obtained.

In the FIG. 6, sub-pixels 141, 142 and 143 for RGB have a common power supply line $V_k$. This is because sub-pixels 141, 142 and 143 are supplied with same signal voltage so that sub-pixels 141, 142 and 143 can be supplied from one power supply. It is not necessary to provide separate power supply for each sub-pixel, and adjacent sub-pixels can have a common power supply line. As a result, the number of the power supply to be provided in the light emitting device can be reduced, leading to reduction in size and thickness of the light emitting device.

A capacitance element may be provided as a means to retain gate-source voltage of the driving transistor 132. However, when the gate capacitance or the channel capacitance of the driving transistor 132, or the parasitic capacitance of the line is used as a means to retain gate-source voltage of the driving transistor 132, additional capacitance element is not necessary.

It should be noted that although all sub-pixels 141, 142 and 143 have same pixel pitch, the invention is not limited to this particular construction. The pixel pitch of sub-pixels 141, 142 and 143 can be modified depending on the light emitting index for each color. This construction further reduces the difference in the luminance among colors.

The FIG. 6 shows a pixel employing a color filter method. The color filter has stripes aligned in horizontal direction relative to the first scan line $Gr_j$. As sub-pixels adjacent to each other in horizontal direction emit light having same color, the patterning of the color filter is not implemented.

This embodiment can be implemented in conjunction with the embodiment 1, 2 and/or 3.

[Embodiment 5]

Electronic devices using the driving method of the light emitting device of the present invention include, there are given, for example, video cameras, digital cameras, goggle type displays (head mount displays), navigation systems, audio reproducing devices (such as car audio and audio components), laptop computers, game machines, mobile information terminals (such as mobile computers, mobile telephones, portable game machines, and electronic books), and image reproducing devices provided with a recording medium (specifically, devices for reproducing a recording medium such as a digital versatile disc (DVD), which includes display capable of displaying images). Practical examples are shown in FIG. 7.

Figure 7A:
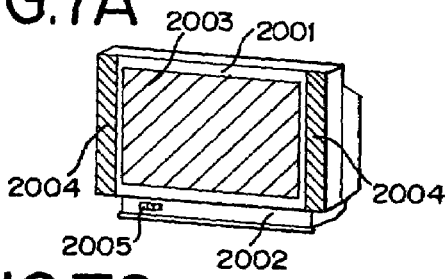
FIGS. 7A to 7H are the exemplary electronics in which a light emitting device according to the invention can be incorporated.

FIG. 7A shows a light emitting element, which contains a casing 2001, a support base 2002, a display portion 2003, a speaker portion 2004, a video input terminal 2005, and the like. The light emitting element of the present invention can be applied to the display portion 2003. Further, the light emitting element shown in FIG. 7A is completed with the present invention. Since the light emitting element is of self-light emitting type, it does not need a back light, and therefore a display portion that is thinner than a liquid crystal display can be obtained. Note that light emitting elements include all information display devices, for example, personal computers, television broadcast transmitter-receivers, and advertisement displays.

Figure 7B:
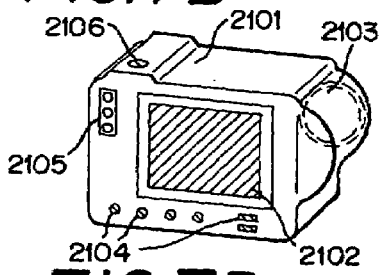

FIG. 7B shows a digital still camera, which contains a main body 2101, a display portion 2102, an image receiving portion 2103, operation keys 2104, an external connection port 2105, a shutter 2106, and the like. The present invention can be applied to the display portion 2102. Further, the digital still camera shown in. FIG. 7B is completed with the present invention.

Figure 7C:
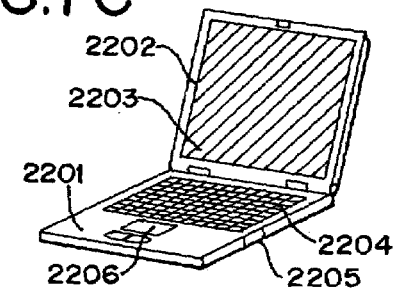

FIG. 7C shows a laptop computer, which contains a main body 2201, a casing 2202, a display portion 2203, a keyboard 2204, external connection ports 2205, a pointing mouse 2206, and the like. The present invention can be applied to the display portion 2203. Further, the light emitting device shown in FIG. 7C is completed with the present invention.

Figure 7D:
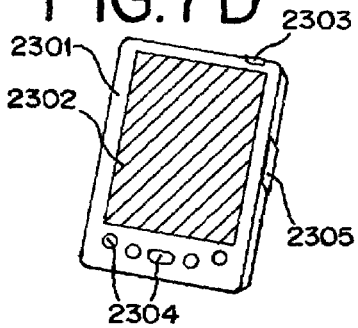

FIG. 7D shows a mobile computer, which contains a main body 2301, a display portion 2302, a switch 2303, operation keys 2304, an infrared port 2305, and the like. The present invention can be applied to the display portion 2302. Further, the mobile computer shown in FIG. 7D is completed with the present invention.

Figure 7E:
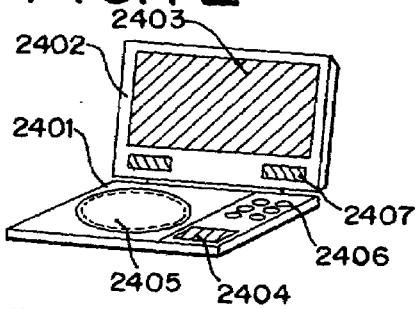

FIG. 7E shows a portable image reproducing device provided with a recording medium (specifically, a DVD reproducing device), which contains a main body 2401, a casing 2402, a display portion A 2403, a display portion B 2404, a recording medium (such as a DVD) read-in portion 2405, operation keys 2406, a speaker portion 2407; and the like. The display portion A 2403 mainly displays image information, and the display portion B 2404 mainly displays character information. The light emitting element of the present invention can be used in the display portion A 2403 and in the display portion B 2404. Note that family game machines and the like are included in the image reproducing devices provided with a recording medium. Further, the image display device shown in FIG. 7E is completed with the present invention.

Figure 7F:
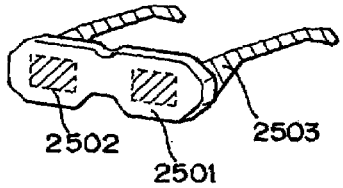

FIG. 7F shows a goggle type display (head mounted display), which contains a main body 2501, a display portion 2502, an arm portion 2503, and the like. The present invention can be used in the display portion 2502. The goggle type display shown in FIG. 7F is completed with the present invention.

Figure 7G:
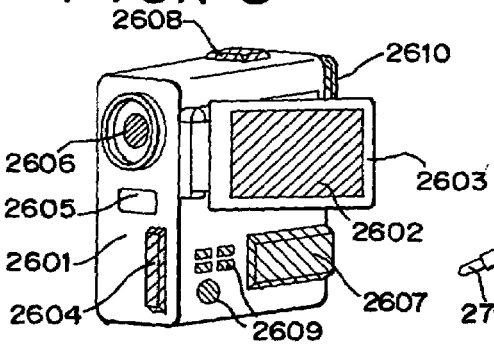

FIG. 7G shows a video camera, which contains a main body 2601, a display portion 2602, a casing 2603, external connection ports 2604, a remote control reception portion 2605, an image receiving portion 2606, a battery 2607, an audio input portion 2608, operation keys 2609, an eyepiece portion 2610, and the like. The present invention can be used in the display portion 2602. The video camera shown in FIG. 7G is completed with the present invention.

Figure 7H:
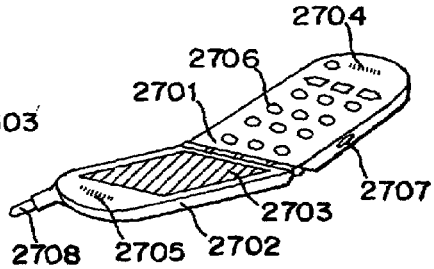
Figure 8A:
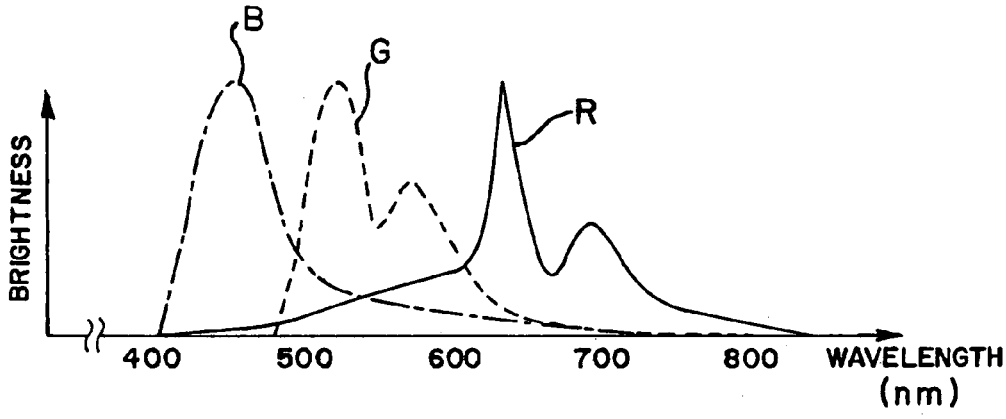
FIGS. 8A and 8B show characteristics of the three primary colors.
Figure 8B:
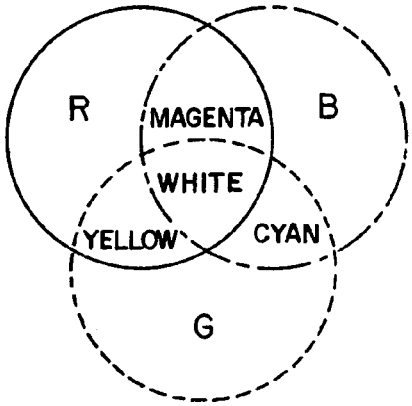

Here, FIG. 7H shows a mobile telephone, which contains a main body 2701, a casing 2702, a display portion 2703, an audio input portion 2704, an audio output portion 2705, operation keys 2706, external connection ports 2707, an antenna 2708, and the like. The present invention can be used in the display portion 2703. Note that, by displaying white characters on a black background, the display portion 2703 can suppress the consumption current of the mobile telephone. Further, the mobile telephone shown in FIG. 7H is completed with the present invention.

When the emission luminance of light emitting materials are increased in the future, it will be able to be applied to a front or rear type projector by expanding and projecting light containing image information having been output lenses or the like.

Cases are increasing in which the above-described electronic devices display information distributed via electronic communication lines such as the Internet and CATVs (cable TVs). Particularly increased are cases where moving picture information is displayed. Since the response speed of the light emitting material is very high, the light emitting device is preferably used for moving picture display.

Since the light emitting device consumes the power in light emitting portions, information is desirably displayed so that the light emitting portions are reduced as much as possible. Thus, in the case where the light emitting device is used for a display portion of a mobile information terminal, particularly, a mobile telephone, an audio playback device, or the like, which primarily displays character information, it is preferable that the character information be formed in the light emitting portions with the non-light emitting portions being used as the background.

As described above, the application range of the present invention is very wide, so that the invention can be used for electronic devices in all of fields. The electronic devices according to this embodiment may use the light emitting device with the structure according to any one of Embodiments 1 to 4.

The light emitting device according to the invention can reduce differences in luminance among lights emitted from sub-pixels for each color, by correcting signals input into each sub-pixel. More particularly, by correcting gradation information of the signals for each color by using light emitting index, the difference in luminance among the lights emitted from the sub-pixels can be reduced. As a result, the invention reduces difference in luminance and improves the white balance on the display, reproducing desirable high-quality image with accurate color and gradation.

Also as sub-pixels of the light emitting device of the invention are supplied with digital video signals having same voltage, voltage can be supplied from one power supply. Therefore, it is not necessary to provide separate power supply line for each column or each row, instead, adjacent columns or adjacent rows can be supplied by a common supply line. This construction allows for higher aperture ratio.

Furthermore, as sub-pixels for RGB are supplied with digital video signals having same voltage, voltage can be supplied from one power supply. Therefore, it is not necessary to provide separate power supply line for each sub-pixel for RGB, instead, adjacent sub-pixels can have a common power supply line. As a result, the number of the power supply necessary for the light emitting device can be reduced, leading to reduction in size and thickness of the light emitting device.

What is claimed is:

1. A light emitting device comprising:

a pixel having a plurality of sub-pixels provided with light emitting elements; and a signal correction circuit for correcting gradation information of a signal voltage, wherein the signal correction circuit comprises a means for calculating a product of the signal voltage and an inverse number of a light emitting index, and wherein the light emitting index is a luminance in each of the plurality of sub-pixels when the same signal voltage is applied to each of the plurality of sub-pixels.

2. The light emitting device according to claim 1, wherein each of the plurality of sub-pixels corresponds to one of red, green and blue which are the light's primary colors.

3. The light emitting device according to claim 1, wherein each of the plurality of sub-pixels has a mono-color material and a color filter/fluorescent filter.

4. The light emitting device according to claim 1, wherein each of the plurality of sub-pixels has a light emitting material corresponding to different color.

5. The light emitting device according to claim 1, wherein the light emitting device is incorporated into an electronic device selected from the group consisting of a video camera, a digital camera, a goggle type display, a navigation system, an audio reproducing devices, a laptop computer, a game machine, a mobile information terminals, and an image reproducing device.

6. A light emitting device comprising:

a pixel having a plurality of sub-pixels provided with light emitting elements for emitting different color from each other; and a signal correction circuit for correcting gradation information of a signal voltage, wherein the signal correction circuit has a means for calculating a product of the signal voltage and an inverse number of a light emitting index, wherein the light emitting index is a luminance in each of the plurality of sub-pixels when the same signal voltage is applied to each of the plurality of sub-pixels, wherein each of the plurality of sub-pixel has a driving means for supplying current to the light emitting element, and a current supply means for supplying current to the driving means, and wherein the current supply means of the plurality of sub-pixel are connected to a power supply.

7. The light emitting device according to claim 6, wherein the light emitting index is the luminance of the light emitting element when same signal voltage is applied to the plurality of sub-pixels.

8. The light emitting device according to claim 6, wherein each of the plurality of sub-pixels corresponds to one of red, green and blue which are the light's primary colors.

9. The light emitting device according to claim 6, wherein each of the plurality of sub-pixels has a mono-color material and a color filter/fluorescent filter.

10. The light emitting device according to claim 6, wherein each of the plurality of sub-pixels has a light emitting material corresponding to different color.

11. The light emitting device according to claim 6, wherein the light emitting device is incorporated into an electronic device selected from the group consisting of a video camera, a digital camera, a goggle type display, a navigation system, an audio reproducing devices, a laptop computer, a game machine, a mobile information terminals, and an image reproducing device.

12. A light emitting device comprising:

a pixel having a plurality of sub-pixels provided with light emitting elements for emitting different color from each other;

a signal correction circuit for correcting gradation information of a signal voltage; and a pixel portion in which the plurality of pixels are arranged in matrix, wherein the signal correction circuit has a means for calculating a product of the signal voltage and an inverse number of a light emitting index, wherein the light emitting index is a luminance in each of the plurality of sub-pixels when the same signal voltage is applied to each of the plurality of sub-pixels, wherein each of the plurality of sub-pixel has a driving means for supplying current to the light emitting element, and a current supply means for supplying current to the driving means, and wherein the current supply means of the plurality of pixel is connected to a power supply.

13. The light emitting device according to claim 12, wherein the light emitting index is the luminance of the light emitting element when same signal voltage is applied to the plurality of sub-pixels.

14. The light emitting device according to claim 12, wherein each of the plurality of sub-pixels corresponds to one of red, green and blue which are the light's primary colors.

15. The light emitting device according to claim 12, wherein each of the plurality of sub-pixels has a mono-color material and a color filter/fluorescent filter.

16. The light emitting device according to claim 12, wherein each of the plurality of sub-pixels has a light emitting material corresponding to different color.

17. The light emitting device according to claim 12, wherein the light emitting device is incorporated into an electronic device selected from the group consisting of a video camera, a digital camera, a goggle type display, a navigation system, an audio reproducing devices, a laptop computer, a game machine, a mobile information terminals, and an image reproducing device.

18. A light emitting device comprising:

a pixel having a plurality of sub-pixels provided with light emitting elements for emitting different color from each other;

a signal correction circuit for correcting gradation information of a signal voltage; and a time division signal generation circuit for setting a plurality of sub-frame period in a unit frame period, wherein the signal correction circuit has a means for calculating a product of the signal voltage and an inverse number of a light emitting index, wherein the light emitting index is a luminance in each of the plurality of sub-pixels when the same signal voltage is applied to each of the plurality of sub-pixels, and wherein the time division signal generation circuit has a means for setting a light emitting status or a non-light emitting status by using the product, in each of the plurality of sub-frame period.

19. The light emitting device according to claim 18, wherein the light emitting index is the luminance of the light emitting element when same signal voltage is applied to the plurality of sub-pixels.

20. The light emitting device according to claim 18, wherein each of the plurality of sub-pixels corresponds to one of red, green and blue which are the light's primary colors.

21. The light emitting device according to claim 18, wherein each of the plurality of sub-pixels has a mono-color material and a color filter/fluorescent filter.

22. The light emitting device according to claim 18, wherein each of the plurality of sub-pixels has a light emitting material corresponding to different color.

23. The light emitting device according to claim 18, wherein the light emitting device is incorporated into an electronic device selected from the group consisting of a video camera, a digital camera, a goggle type display, a navigation system, an audio reproducing devices, a laptop computer, a game machine, a mobile information terminals, and an image reproducing device.

24. A method for driving a light emitting device having a light emitting element in a sub-pixel comprising the steps of:

correcting gradation information of a signal voltage by calculating a product of the signal voltage and an inverse number of a light-emitting index, and wherein the light emitting index is a luminance in each of the plurality of sub-pixels when the same signal voltage is applied to each of the plurality of sub-pixels.

25. The method according to claim 24, wherein the sub-pixel corresponds to one of red, green and blue which are the light's primary colors.

26. The method according to claim 24, wherein the sub-pixel has a mono-color material and a color filter/fluorescent filter.

27. The method according to claim 24, wherein the light emitting device is incorporated into an electronic device selected from the group consisting of a video camera, a digital camera, a goggle type display, a navigation system, an audio reproducing devices, a laptop computer, a game machine, a mobile information terminals, and an image reproducing device.

* * * * *